US009027901B2

(12) United States Patent
Pooler

(10) Patent No.: US 9,027,901 B2
(45) Date of Patent: May 12, 2015

(54) ROOFTOP AIR CONDITIONING VIBRATION ABSORPTION SYSTEM

(71) Applicant: James Pooler, Wooster, OH (US)

(72) Inventor: James Pooler, Wooster, OH (US)

( * ) Notice: Subject to any disclaimer, the term of this patent is extended or adjusted under 35 U.S.C. 154(b) by 101 days.

(21) Appl. No.: 13/648,378

(22) Filed: Oct. 10, 2012

(65) Prior Publication Data

US 2013/0087677 A1 Apr. 11, 2013

Related U.S. Application Data

(60) Provisional application No. 61/545,360, filed on Oct. 10, 2011.

(51) Int. Cl.

| | |
|---|---|
| ***F16F 7/02*** | (2006.01) |
| ***F24F 13/32*** | (2006.01) |
| ***F24F 1/60*** | (2011.01) |

(52) U.S. Cl.

CPC ..... *F24F 13/32* (2013.01); *Y10T 29/49826* (2015.01); *F24F 1/60* (2013.01)

(58) Field of Classification Search

USPC ..... 248/560, 561, 562, 564, 578, 618, 620, 248/624, 638; 267/286, 291, 70, 178, 91, 267/166, 169; 52/167.4, 167.8, 573.1; 411/531, 546; 403/408.1

See application file for complete search history.

(56) References Cited

U.S. PATENT DOCUMENTS

| | | | | |
|---|---|---|---|---|
| 1,880,280 | A * | 10/1932 | Replogle | 312/351 |
| 3,721,106 | A | 3/1973 | Bierworth et al. | |
| 3,878,655 | A | 4/1975 | Toth et al. | |
| 3,890,752 | A * | 6/1975 | Bolton | 52/775 |
| 4,200,256 | A * | 4/1980 | Thiel | 248/548 |
| 4,565,039 | A | 1/1986 | Oguro et al. | |
| 4,598,503 | A | 7/1986 | Berger et al. | |
| 6,092,735 | A * | 7/2000 | Molyneux | 238/341 |
| 6,648,295 | B2 | 11/2003 | Herren et al. | |
| 7,128,302 | B2 | 10/2006 | Dubensky et al. | |
| 7,458,556 | B1 * | 12/2008 | Manucy | 248/676 |
| 8,528,875 | B2 * | 9/2013 | Wilson et al. | 248/561 |

* cited by examiner

*Primary Examiner* — Alfred J Wujciak

(74) *Attorney, Agent, or Firm* — Roger D. Emerson; Emerson Thomson Bennett, LLC

(57) ABSTRACT

A vibration absorption system for a rooftop mounted air handling unit is disclosed herein. The vibration absorption system includes an upper rail. The vibration absorption system also includes a lower rail. The vibration absorption system also includes at least one biasing device disposed between the upper rail and the lower rail. The vibration absorption system also includes a fastener having a head and extending through at least a first portion of the upper rail and at least a first portion of the lower rail to interconnect the upper rail and the lower rail. The vibration absorption system also includes a nut releasably engaged with the fastener. The first portion of the upper rail and the first portion of the lower rail are disposed between the nut and the head. The nut is adjustably positionable along a length of the fastener wherein adjustment of the nut along the length of the fastener varies an extent of compression of the at least one biasing device. A method associated with the system is also disclosed.

13 Claims, 2 Drawing Sheets

ROOFTOP AIR CONDITIONING VIBRATION ABSORPTION SYSTEM

CROSS-REFERENCE TO RELATED APPLICATIONS

This application claims the benefit of U.S. Provisional Patent Application Ser. No. 61/545,360 for a Prepackaged Air-Conditioning Vibration Isolation Rail System, filed on Oct. 10, 2011, which is hereby incorporated by reference in its entirety.

BACKGROUND OF THE INVENTION

1. Field of the Invention

The invention relates to a vibration absorption system for a rooftop mounted air conditioning unit.

2. Description of Related Prior Art

U.S. Pat. No. 4,598,503 discloses a vibration absorption mounting for a rooftop air handling unit or the like. The arrangement of so-called upper and lower curbs with interposed springs having an interconnected condition allowing for their delivery to an installation site as a single modular section. At the site each section is bolted together and then readily released from each other to then allow vibratory movement in the upper curb relative to said lower curb on the interposed springs. The release is produced by the force urgency in the springs which dampen the vibration of the air handling unit which is mounted on the curbs.

SUMMARY OF THE INVENTION

In summary, the invention is a vibration absorption system for a rooftop mounted air handling unit. The vibration absorption system includes an upper rail. The vibration absorption system also includes a lower rail. The vibration absorption system also includes at least one biasing device disposed between the upper rail and the lower rail. The vibration absorption system also includes a fastener having a head and extending through at least a first portion of the upper rail and at least a first portion of the lower rail to interconnect the upper rail and the lower rail. The vibration absorption system also includes a nut releasably engaged with the fastener. The first portion of the upper rail and the first portion of the lower rail are disposed between the nut and the head. The nut is adjustably positionable along a length of the fastener wherein adjustment of the nut along the length of the fastener varies an extent of compression of the at least one biasing device. A method associated with the system is also disclosed.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENT

The invention, as demonstrated by the exemplary embodiment described below, can provide embodiments that define a modular vibration absorption system that can be delivered to a work site and be installed, without requiring any on-site assembly. While prior art systems claim to be modular, embodiments of the present invention can yield benefits over the art by obviating some installation steps required of these prior systems.

Figure 1:
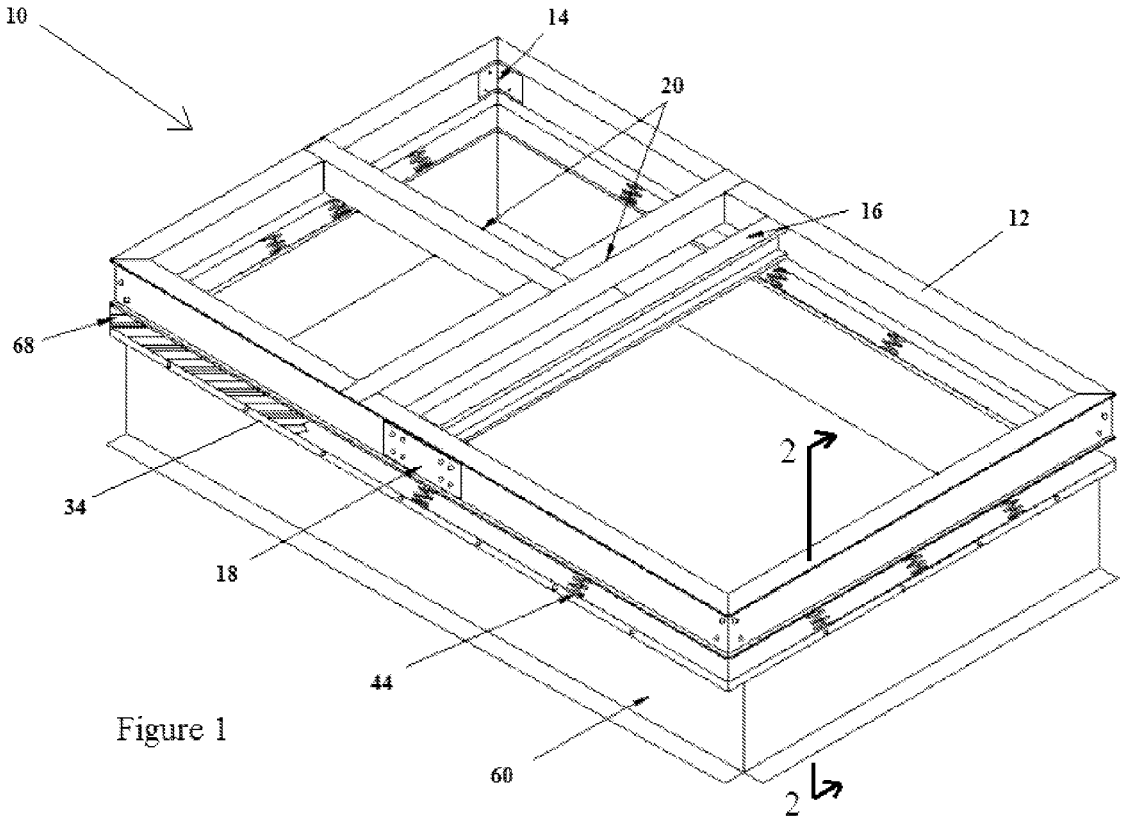
FIG. 1 is a perspective view of a vibration absorption system according to an embodiment of the present invention.

FIG. 1 shows a vibration absorption system 10 for a rooftop mounted air handling unit according to an embodiment of the invention. The vibration absorption system 10 includes an upper rail 12. The upper rail 12 can be a single, integrally-formed structure or a formed from a plurality of sub-components connected together. In the exemplary embodiment, the upper rail 12 can be formed from four sub-components and define a rectangular perimeter. The four sub-components can be held together at each corner with corner brackets 14 mechanically fastened to the sub-components.

In the exemplary embodiment, a cross brace 16 and splice plates 18 are added for further unit adaptation. The cross brace 16 and the splice plates 18 can also be used when additional length is needed to add to the system 10. Duct supports 20 can be connected to the sides of the upper rail 12. The duct supports 20 can be designed to hold the weight of the building ductwork.

Figure 2:
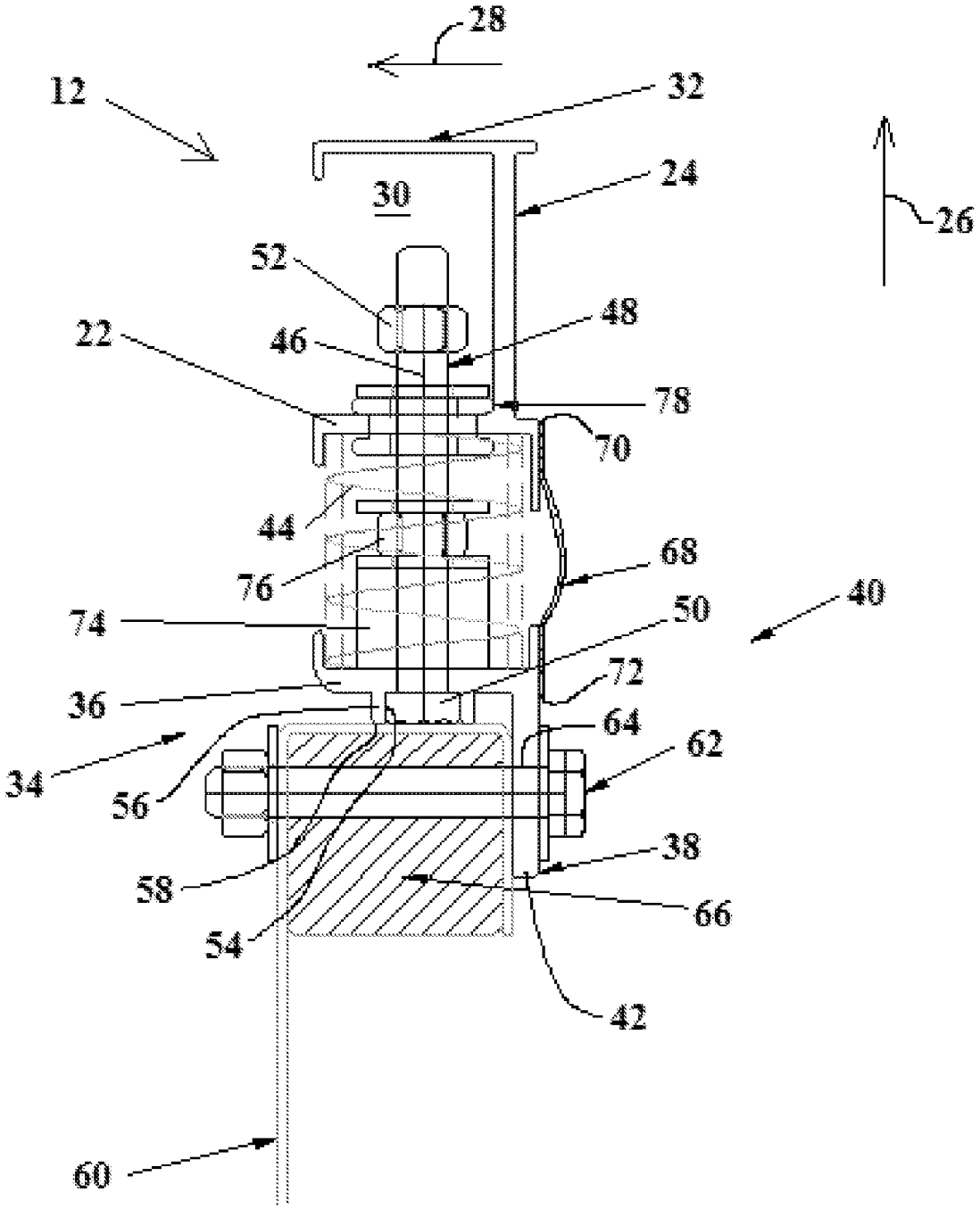
FIG. 2 is a cross-sectional view taken through section lines 2-2 in FIG. 1.

Referring now to FIG. 2, the upper rail 12 can include a first portion 22 and an arm 24 extending away from the first portion 22. The arm 24 can extend in first and second transverse directions 26, 28 to define a channel 30 with the first portion 22. The arm 24 can project at a radially outer side of the upper rail 12. "Radially outer" is used in reference to the perimeter of the system 10, with the inside of the perimeter being inner and outside being outer. A planar support surface 32 is defined on an opposite side of the channel 30 relative to the first portion 22. The planar support surface 32 can be substantially flat and horizontal. An HVAC unit can be placed on the planar support surface 32.

The first portion 22 and the arm 24 can be integrally-formed with respect to one another. "Integrally-formed" refers to the fact that in the exemplary embodiment the first portion 22 and the arm 24 are formed together rather than being formed separately and then subsequently joined. The term defines a structural feature since structures that are integrally-formed are structurally different than structures that are comprised of subcomponents formed separately and then subsequently joined. "Integral" means consisting or composed of parts that together constitute a whole and thus encompasses structures of more than one part wherein the parts are either integrally-formed or formed separately and then subsequently joined.

The vibration absorption system 10 also includes a lower rail 34. The lower rail 34 can be constructed in a similar or different manner with respect to the upper rail 12. The lower rail 34 can be a single, integrally formed structure or formed from a plurality of sub-components connected together. The lower rail 34 can include a first portion 36 and an arm 38 extending away from the first portion 36 to a distal end 42. The first portion 34 and the arm 36 can be integrally-formed with respect to one another. The arm 38 can extend in a direction away from the upper rail 12 on an outer side of the lower rail 34. The arm 38 can cooperate with the first portion 36 in defining a corner cross-section 40.

The vibration absorption system 10 can also include at least one biasing device disposed between the upper rail 12 and the lower rail 34. The exemplary embodiment includes a plurality of biasing devices 44 spaced about the perimeter of the system 10. Each biasing device 44 can be disposed between the upper rail 12 and the lower rail 34 and extend along a respective compression axis 46. Each exemplary biasing device 44 can be elastically deformable along its compression axis 46.

The vibration absorption system 10 also includes a fastener having a head and extending through at least a first portion of the upper rail 12 and at least a first portion of the lower rail 34 to interconnect the upper rail 12 and the lower rail 34. In the exemplary embodiment of the invention, a threaded fastener 48 having a head 50 extends through the first portion 22 of the upper rail 12 and the first portion 36 of the lower rail 34 to interconnect the upper rail 12 and the lower rail 34. A grommet 78 can be positioned in an aperture of the upper rail 12 and sealing engage the fastener 48. In the exemplary embodiment, the fastener 48 is centered on the central, compression axis 46 of the biasing device 44 and extends within the biasing device 44.

The vibration absorption system 10 also includes a nut 52 releasably engaged with the fastener 48. The first portion 22 of the upper rail 12 and the first portion 36 of the lower rail 34 are disposed between the nut 52 and the head 50. The nut 52 is adjustably positionable along a length of the fastener 48 such that adjustment of the nut 52 along the length of the fastener 48, by turning the nut 52 relative to the fastener 48, varies an extent of compression of the at least one biasing device 44.

In various embodiments of the invention, one of the nut 52 and the head 50 can be disposed in the channel 30 and the other can be disposed in the corner cross-section 40. In the exemplary embodiment, the nut 52 can be positioned in the channel 30. The nut 52 can be accessed and adjusted from inside the perimeter of the system 10. The nut 52 is thus at least partially enclosed in the channel 30.

The vibration absorption system 10 can also include a pocket 54 defined by one of the upper rail 12 and the lower rail 34. In the exemplary embodiment, the pocket 54 receives and captures the head 50 such that the head 50 is prevented from rotating relative to the one of the upper rail 12 and the lower rail 34. The pocket 54 can be formed in a protuberance 56 projecting from the first portion 36 of the lower rail 34, away from the upper rail 12. The protuberance 56 can define a planar surface 58 surrounding the pocket 54 and facing away from the at least one biasing device 44. A top surface of the head 50 and the planar surface 58 can be substantially coplanar. The surface 58 can act as a support surface facing vertically downward and operable to engage a portion of a roof. The distal end 42 of the arm 38 can be vertically lower than the support surface 58 and also lower than the first portion 36 of the lower rail 34.

In operation, the system 10 can be assembled, shipped to a work site, and quickly mounted on a roof. 12. At the work site, the system 10 can be lowered to rest the lower rail 34 on a roof curb 60. The lower rail 34 can then be directly fastened to a roof curb 60 by extending fastener such as bolt 62 horizontally through the lower rail 34 and through the roof curb 60. The arm 38 of the lower rail 34 can define apertures such as aperture 64 to receive the bolt 62. The aperture 64 can extend through the arm 38 along an axis transverse to a compression axis 46 of the biasing device 44. A nailer 66 can define an interior of the roof curb 60 and have an aperture to receive the bolt 62. An HVAC unit can be placed on and supported by the surface 32. The system 10 can then support the weight of an HVAC unit mounted on the roof through biasing devices 44. Biasing devices 44 can be added and/or removed depending upon the weight and the center of gravity of the HVAC unit which is being supported. The roof curb 60 then supports the weight of the HVAC unit and the system 10.

The head of the fastener is positioned to rest on a portion of the roof. In the exemplary embodiment, the head 50 of the fastener 48 is positioned to rest on the roof curb 60 portion of the roof. The first portion 36 of the lower rail 34 is spaced vertically from the roof curb portion 60 of the roof with the plurality of protuberances 56 spaced from one another and each projecting downward from the first portion 36 of the lower rail 34.

Embodiments of the invention can also include a seal 68. A first edge 70 of seal 68 can be connected to the upper rail 12 and a second edge 72 of seal 68 can be connected opposite the first edge 70 to the lower rail 34. The seal 68 can be mounted before the system is delivered to the work site and/or before the system is mounted on a roof. In FIG. 1, a portion of the seal 68 is omitted to show biasing devices 44, however the seal 68 can extend around the entire perimeter of the system 10. The seal 68 prevents weather intrusion into the HVAC unit through the open areas around springs 20, the gaps between the upper and lower rails 12, 34.

Embodiments of the invention can include a restraint stiffener 74 that encircles the fastener 48. The a restraint stiffener 74 can be clamped to the lower rail 34 with a nut 76. The first portion 36 can be pressed between the head 50 and the restraint stiffener 74. Horizontal movement and shifting of the upper rail 12 relative to the lower rail 34 is resisted by the fastener 48 and restraint stiffener 74.

The exemplary roof curb 60, biasing device 44, cross brace 16, and duct supports 20 can be made of steel or aluminum. The upper rail 12, lower rail 34, and the restraint stiffener 74 can be made of aluminum. The corner brackets 14 and splice plates 18 can be made of aluminum. The fasteners 48 and 62 and the nuts 62 and 76 can be made of steel. The grommet 78 and seal 68 can be made of an elastomeric material.

The advantages of the present invention include, without limitation, the ability to preload the biasing devices in order to increase the horizontal stiffness of the system in an unloaded state. Also, the restraint stiffer reduces the bending moment on the fastener 48. Further, the lower rail can be designed to capture the head of fastener, enhancing the efficiency of the assembly process. The exemplary embodiment and other embodiments of the broader invention can pre-assembled and shipped to a work site. Assembly on a roof can be accomplished merely by installing bolts through the side of lower rail.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

What is claimed is:

1. A vibration absorption system for a rooftop mounted air handling unit comprising:

an upper rail for supporting the air handling unit;

a lower rail for mounting on the rooftop;

at least one biasing device disposed between said upper rail and said lower rail;

a fastener having a head and extending through at least a first portion of said upper rail and at least a first portion of said lower rail to interconnect said upper rail and said lower rail; and a restraint stiffener that encircles said fastener and which is clamped to said lower rail with a first nut, wherein said restraint stiffener is positioned such that said first portion of said lower rail is pressed between said head of said fastener and said restraint stiffener and wherein said restraint stiffener is capable of reducing the fastener's bending moment;

a second nut releasably engaged with said fastener, said first portion of said upper rail and said first portion of said lower rail disposed between said second nut and said head, said second nut adjustably positionable along a length of said fastener wherein adjustment of said second nut along said length of said fastener varies an extent of compression of said at least one biasing device.

2. The vibration absorption system of claim 1 further comprising: a pocket defined by one of said upper rail and said lower rail that receives and captures said head such that said head is prevented from rotating relative to said one of said upper rail and said lower rail.

3. The vibration absorption system of claim 2 wherein said pocket is formed in a protuberance projecting from said first portion of said lower rail away from said upper rail.

4. The vibration absorption system of claim 3 wherein said protuberance defines a planar surface surrounding said pocket and wherein said head and said planar surface are substantially coplanar.

5. The vibration absorption system of claim 4 wherein planar surface faces away from said at least one biasing device.

6. The vibration absorption system of claim 1 wherein said lower rail further comprises: a support surface being at least substantially horizontal and facing vertically downward and operable to engage a portion of a roof; and an arm extending vertically to distal end that is vertically lower than said support surface and said first portion of said lower rail.

7. The vibration absorption system of claim 6 further comprising: at least one aperture extending through said arm along an axis transverse to a compression axis of said at least one biasing device; and a second fastener extending through said at least one aperture.

8. The vibration absorption system of claim 1 wherein said upper rail further comprises: an arm extending away from said first portion of said upper rail and extending in at least first and second transverse directions to at least partially enclose one of said nut and said head in a channel.

9. The vibration absorption system of claim 8 wherein said arm defines a substantially flat, horizontal surface disposed outside of said channel.

10. A vibration absorption system for a rooftop mounted air handling unit comprising:

an upper rail for supporting the air handling unit, having a first portion and an arm extending away from said first portion in first and second transverse directions to define a channel with said first portion and a planar support surface on an opposite side of said channel relative to said first portion;

a lower rail for mounting on the rooftop, having a first portion and an arm extending away from said first portion of said lower rail and away from said upper rail to cooperate with said first portion of said lower rail in defining a corner cross-section;

at least one biasing device disposed between said upper rail and said lower rail extending along a compression axis wherein said at least one biasing device is elastically deformable along said compression axis;

a fastener having a head and extending through at least said first portion of said upper rail and at least said first portion of said lower rail to interconnect said upper rail and said lower rail;

a restraint stiffener that encircles said fastener and which is clamped to said lower rail with a first nut, wherein said restraint stiffener is positioned such that said first portion of said lower rail is pressed between said head of said fastener and said restraint stiffener and wherein said restraint stiffener is capable of reducing the fastener's bending moment;

a second nut releasably engaged with said fastener, said first portion of said upper rail and said first portion of said lower rail disposed between said second nut and said head, said second nut adjustably positionable along a length of said fastener wherein adjustment of said second nut along said length of said fastener varies an extent of compression of said at least one biasing device, wherein one of said second nut and said head is disposed in said channel and the other is disposed in said corner cross-section.

11. The vibration absorption system of claim 10 wherein said first portion and said arm of said upper rail are integrally-formed with respect to one another.

12. The vibration absorption system of claim 11 wherein said first portion and said arm of said lower rail are integrally-formed with respect to one another.

13. The vibration absorption system of claim 12 wherein: said upper rail and said lower rail include corresponding inner and outer radial sides; and both of said arm of said upper rail and said arm of said lower project vertically from said respective outer sides.

* * * * *